United States Patent [19]

Stubenfoll et al.

[11] Patent Number: 4,717,367

[45] Date of Patent: Jan. 5, 1988

[54] TOY VEHICLE WITH EXTENDABLE SECTION

[75] Inventors: Leonard J. Stubenfoll, Chicago; Russell G. Rasmussen, Skokie; Howard J. Morrison, Deerfield, all of Ill.

[73] Assignee: Marvin Glass & Associates, Chicago, Ill.

[21] Appl. No.: 819,735

[22] Filed: Jan. 21, 1986

[51] Int. Cl.[4] ..... A63H 17/02

[52] U.S. Cl. ..... 446/437; 446/457; 446/441

[58] Field of Search ..... 446/457, 437, 441, 448, 446/462, 463

[56] References Cited

U.S. PATENT DOCUMENTS

| | | | |
|---|---|---|---|
| 1,682,764 | 9/1928 | Mohr | 446/437 X |
| 2,607,163 | 8/1952 | Lohr | 446/457 X |
| 4,459,776 | 7/1984 | Jaworski et al. | 446/457 X |

*Primary Examiner*—Kenneth J. Dorner
*Assistant Examiner*—Gerald A. Anderson
*Attorney, Agent, or Firm*—John S. Pacocha

[57] ABSTRACT

A toy vehicle having a front to back dimension includes a body with a forward end and a rearward end. The body carries an extendable tail section adjacent the rearward end for extension from a retracted position adjacent the rearward end to an extended position for increasing the front to back dimension of the vehicle. When the vehicle encounters a change in the angle of the playing surface or a force is otherwise exerted on the distal portion of the extendable section, a motor driven gear engages a rack and drives the extendable section away from the body of the vehicle.

12 Claims, 9 Drawing Figures

TOY VEHICLE WITH EXTENDABLE SECTION

BACKGROUND OF THE INVENTION

1. Field of the Invention

This invention relates generally to toy vehicles and more particularly to a toy vehicle having an extendable section.

2. Background Art

Toy vehicles, in particular, motorized toy vehicles that can climb up and over various terrain are popular toys. One example of such toy vehicles is the claw wheel vehicle of U.S. Pat. No. 4,547,173. Depending on the length of the wheel base and weight distribution, toy vehicles climbing up inclines, regardless of the traction the wheels have on the surface, can tip over backwardly. Merely making a vehicle with a permanently extended wheel base may provide a solution to tipping of the vehicle, but does not provide much additional play or entertainment. Accordingly, there is a need for a toy vehicle with an extendable section for effectively increasing the front to back dimension of the vehicle to reduce tipping when the vehicle traverses an incline on a playing surface.

SUMMARY OF THE INVENTION

The present invention is concerned with providing a toy vehicle with a section that extends away from the main body of the vehicle in order to increase the front to back dimension of the vehicle. This and other objects and advantages of the invention are achieved in a toy vehicle having a body with a forward end and a rearward end and an extendable section carried by the body adjacent one end for extension from a first position adjacent the one end toward a second position. A proximal portion of the section engages the body with the distal portion spaced from both the proximal portion and the one end of the body. Upon occurrence of a predetermined condition such as the vehicle encountering a change in the angle of the playing surface or the exertion of a force upon the distal portion of the section in a direction generally transverse to the playing surface, the section is extended away from the body. Motor driven extension of the section is effected through gearing which includes a rack formed as part of the extendable section and a motor driven gear that engages the rack upon occurrence of the predetermined condition. Normally the rack is spaced out of engagement with the gear when the section is in the first position but is biased down into engagement with the gear upon occurrence of the predetermined position. In addition, a pivoting part may be linked to the extendable section so that the part pivots from a first condition to a second condition as the section moves from its first position toward its second position.

BRIEF DESCRIPTION OF THE DRAWINGS

For a better understanding of the present invention reference may be had to the accompanying drawings in which.

DETAILED DESCRIPTION OF THE PREFERRED EMBODIMENT

Figure 1:
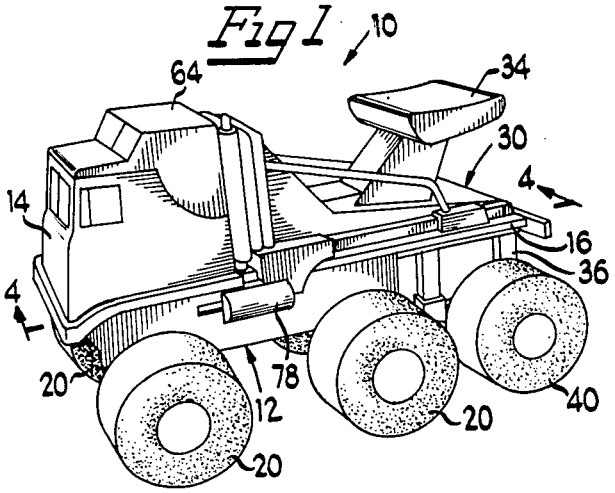
FIG. 1 is a perspective view of a toy vehicle embodying the present invention in its quiescent, compressed condition.
Figure 3:
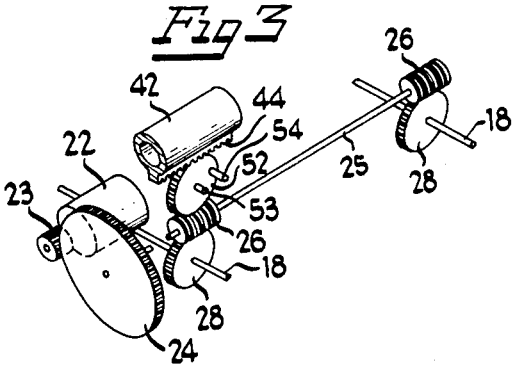
FIG. 3 is an enlarged scale, perspective view of the drive mechanism.
Figure 2:
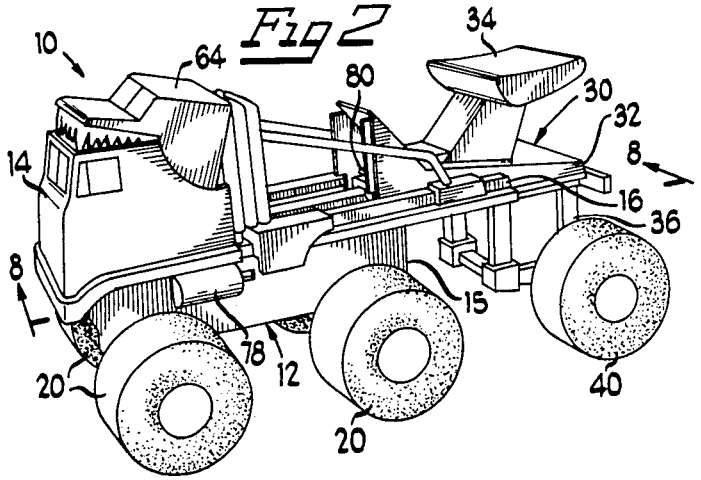
FIG. 2 is a perspective view of the vehicle shown in FIG. 1 in its extended condition.
Figure 9:
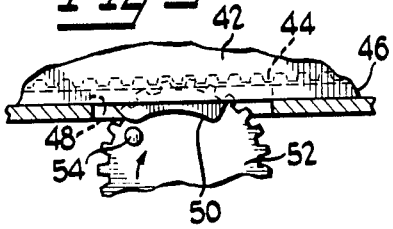
FIG. 9 is an enlarged scale, fragmentary sectional view showing a portion of the extension driving mechanism from the side opposite that shown in FIG. 4.

Referring now to the drawings in which like parts are designated by like references numerals throughout the several views, there is shown in FIGS. 1 and 2 a toy vehicle 10 having a body 12 with a forward end 14, a rearward end 15 and rearwardly overhanging side rails 16. Vehicle 10 has a longitudinal dimension extending from front to back. Body 12 carries a pair of spaced apart axles 18 which are substantially parallel to each other and transverse to the front to back dimension. At the end of each axle a wheel 20 is mounted to provide for rolling movement of the vehicle along a playing surface.

Mounted within body 12 is a motor 22 powered by batteries (not shown). A motor pinion 23 is in engagement with a drive gear 24 mounted on shaft 25 for rotation with the shaft. Shaft 25 is journaled for rotation inside the opposed forward and rearward end walls of body 12. Also mounted on shaft 25 for rotation with the shaft are a pair of spaced apart worms 26. Each worm 26 engages a respective worm gear 28 mounted on one of axles 18 for rotation with the axle. Thus, motor 22 drives all four wheels 20.

Carried by body 12 for rearward extension is a tail section 30 having a distal end 32. Extending upwardly from section 30 is a spoiler 34. Depending from the back end of the section is a frame 36 carrying an axle 38 on the ends of which are wheels 40. Axle 38 is substantially parallel to axles 18 carried by body 12. Forwardly of rear end 32, section 30 has a proximal portion including a beam 42 with a rack 44 on its lower face.

Beam 42 is received for reciprocating movement along the front to back dimension of the vehicle in slide channel member 46. Adjacent rearward end 15 of body 12, coaxial stubshafts 47, each extending outwardly from a respective side of slide channel member 46, are journaled in body 12. Accordingly, stubshafts 47 secure channel member 46 against movement along the longitudinal dimension while mounting the channel member for up and down movement about the axes of stubshafts 47.

Figure 4:
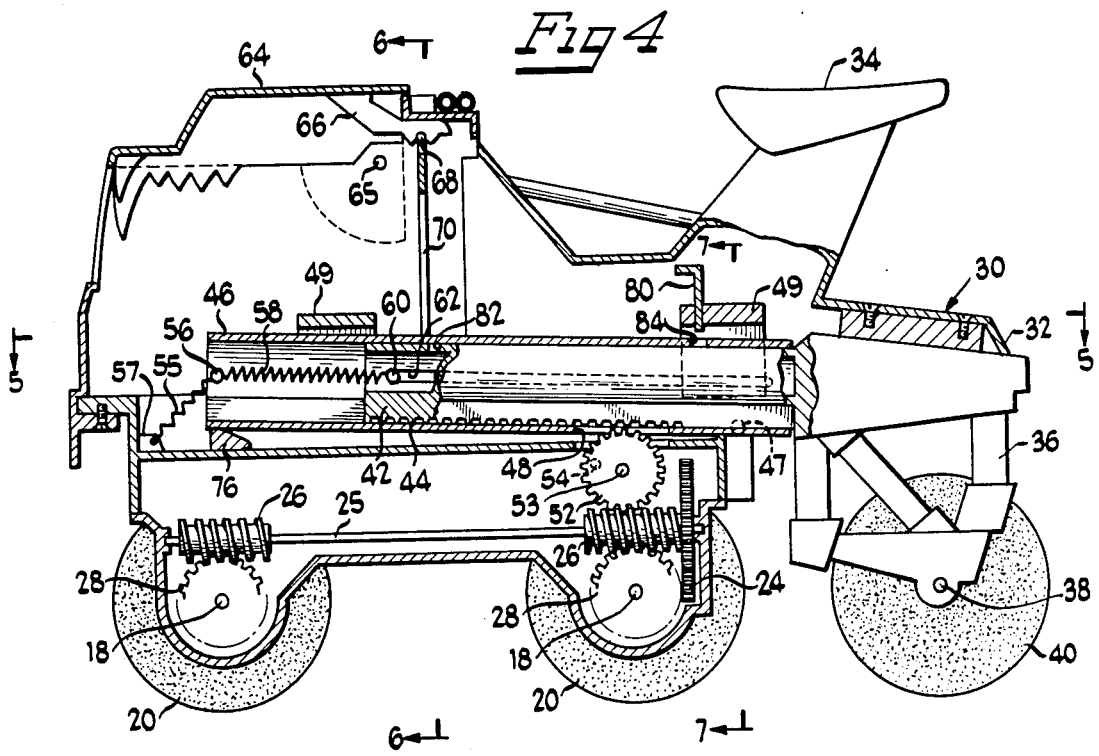
FIG. 4 is an enlarged scale, sectional view taken generally along line 4—4 of FIG. 1.
Figure 5:
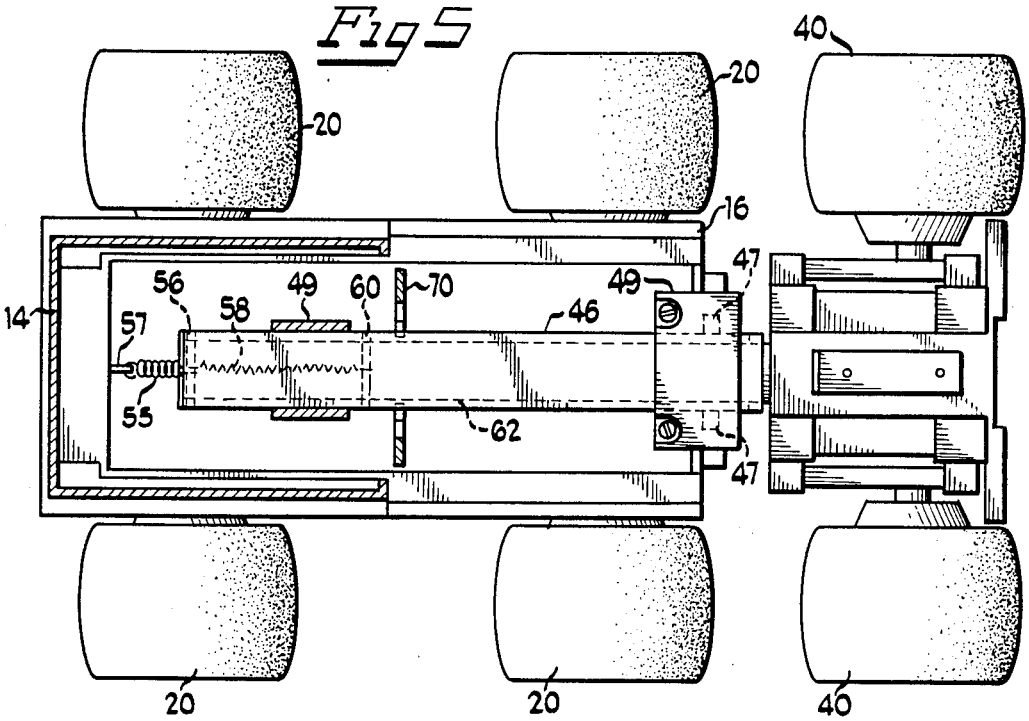
FIG. 5 is a sectional view taken generally along line 5—5 of FIG. 4.
Figure 6:
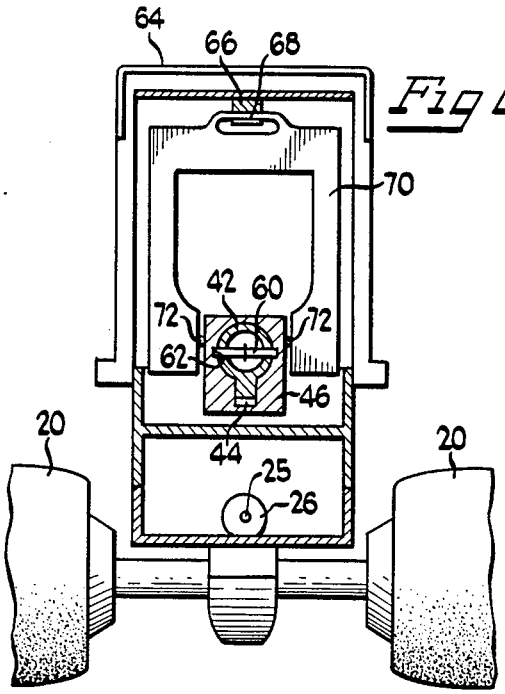
FIG. 6 is a sectional view taken generally along line 6—6 of FIG. 4.
Figure 7:
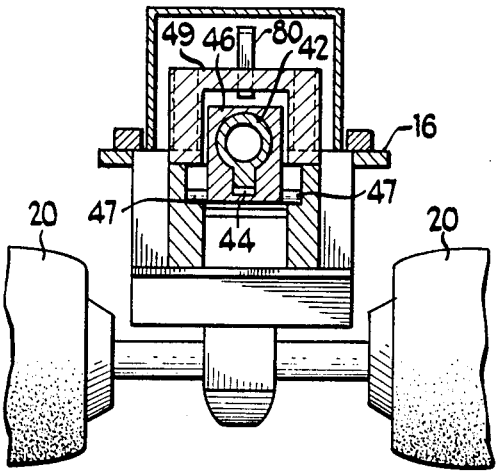
FIG. 7 is a sectional view taken generally along line 7—7 of FIG. 4.

Tail section 30 is biased by the weight of the frame, axle and wheel assemblies down about the axes of coaxial stubshafts 47 in a clockwise direction as shown in FIG. 4. When section 30 is in the first, retracted position shown in FIGS. 1 and 4, the vertical distance between the axes of coaxial stubshafts 47 and the lowermost, surface engaging, point of wheel 40 is less than the vertical distance between the axes of stubshafts 47 and the lowermost, surface engaging, point of wheels 20. Brackets 49 limit the extent of up and down movement of member 46.

On the underside of slide channel 46 is an elongated slot 48 generally centrally disposed with respect to the sides of the slide channel. Cam surface 50 depends down below the rest of the length of slide channel 46 adjacent one side of slot 48. Aligned under the slot, an extension drive worm gear 52 is mounted for rotation on a shaft 53 carried by body 12. Slot 48 is wide enough and long enough to permit about a quarter of gear 52 to project into channel member 46. Gear 52 is in engagement with rearward worm 26. A pin 54 projects out of gear 52 generally parallel to shaft 53 on the same side that cam 50 depends from the slide channel.

Counterbalancing the clockwise bias of the weight of the distal portion of tail section 30 about the axes of shafts 47 is a spring 55. One end of the spring is secured about pin 56 extending across the forward portion of channel member 46 and the other end of spring 55 is secured to a tab 57 that may be integrally formed as part of body 12. Another spring, 58, also has one end secured about pin 56. The other end of spring 58 is secured to a pin 60, that is generally parallel to pin 56 but extends across beam 42. Spring 58 biases tail 30 into its first, quiescent, nonextended position. Each end of pin 60 extends out through a slot 62 in an opposed side of channel member 46 to provide additional guidance for beam 42 as it reciprocates in and out of slide channel 46. In addition, the ends of slot 62 serve as stops to limit the extent of inward and outward movement of beam 42.

As illustrated in FIG. 4, when section 30, in its quiescent, nonextended position, is biased clockwise, rack 44 is spaced from and out of engagement with gear 52. However, when the toy vehicle begins to climb up an incline such as the approximately fifteen degree incline illustrated in FIG. 8, section 30 articulates or pivots, about the axes of stubshafts 47, and with the aid of counterbalancing spring 55, rack 44 moves counterclockwise down into engagement with gear 52. As gear 52 engages the rack, it drives section 30 back away from body 12 against the bias of spring 58. When the vehicle returns to a substantially horizontal playing surface and pin 54 engages cam 50, beam 42 is pivoted up and away out of engagement with gear 52 permitting the bias of spring 58 to retract beam 42.

Figure 8:
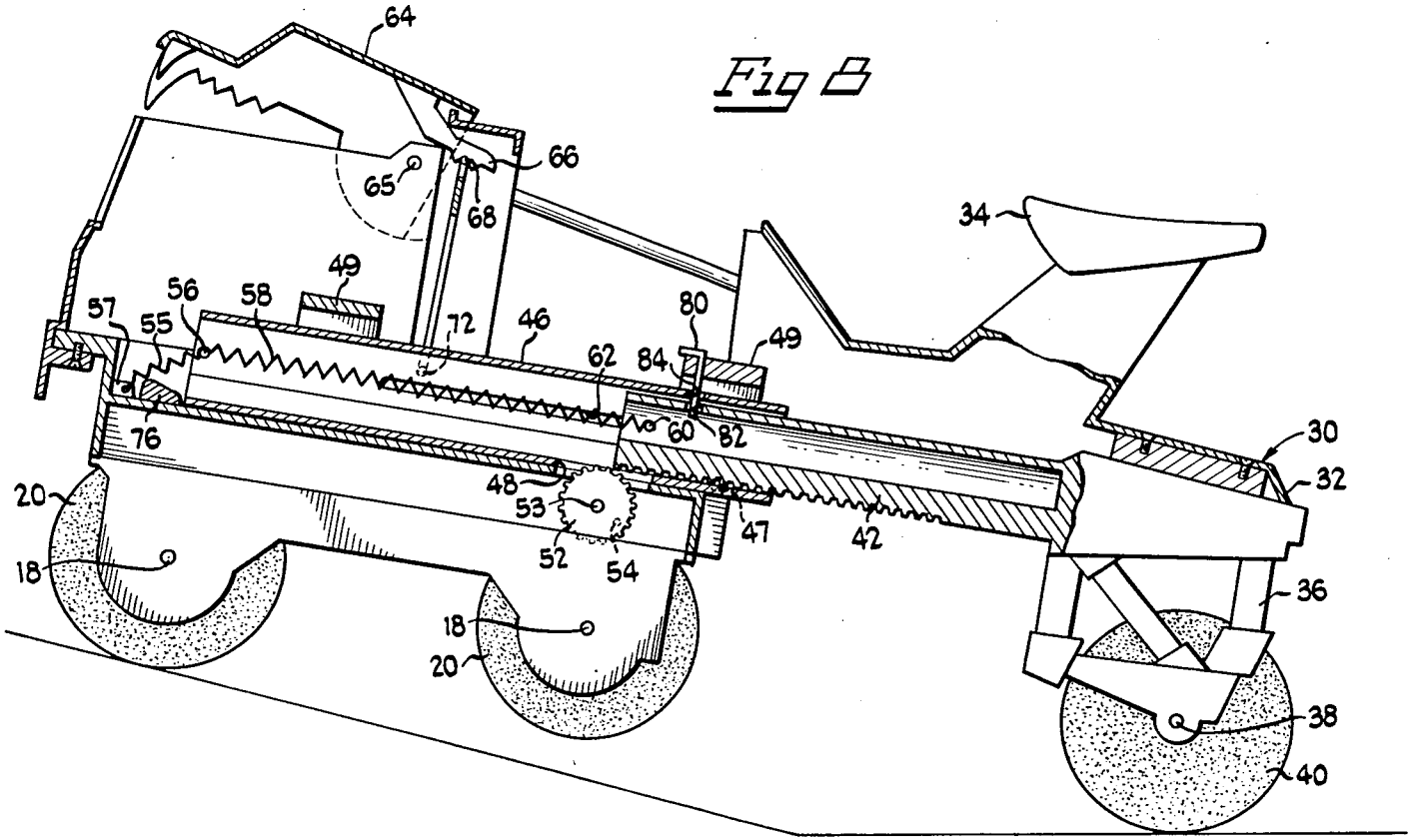
FIG. 8 is an enlarged scale, sectional view taken generally along line 8—8 of FIG. 2 but showing the vehicle starting up an incline.

Should vehicle 10 proceed along a constant incline, the bias resulting from the rearward wheels on the body being spaced from the playing surface as illustrated in FIG. 8, is reduced and the tail section tends to be biased to return to its retracted, nonextended position. However, even when the vehicle proceeds along a constant incline, if the incline is steep enough so that the front wheels of the vehicle become spaced from the surface as the vehicle tends to flip back over about the rearwardmost axle, a bias will result. Such a bias will maintain the rack 44 and gear 52 in engagement and, hence, tail 30 in its extended position. There may be some intermittent retraction, after pin 54 engages cam 50 while the vehicle is moving up a steep incline or encountering a significant change in the angle of the surface along which it is moving immediately followed by extension since gear 52 will again engage rack 44.

At the forward end of body 12, a roof 64 is mounted for pivoting about shaft 65 between a first closed condition as illustrated in FIGS. 1 and 4 and a second open condition as illustrated in FIGS. 2 and 8. Pivotal movement of roof 64 is effected through a linkage comprising an arm 66 that has one end secured to the underside of roof 64. The other end of arm 66 is pivotally linked at 68 to the upper end of a strut 70. At its lower end, the strut is pinned to channel member 42 at 72. Accordingly, when the channel member pivots counterclockwise about the axes of stubshafts 47, it moves strut 70 down, which in turn pulls on arm 66 to pivot roof 64 open.

Vehicle 10 is provided with a slideable front wedge lock 76 operable from outside the vehicle by manipulation of saddle tanks 78 to block the proximal portion of section 30 up as shown in FIG. 4. In the blocked up position, section 30 is effectively locked in its first, retracted position. Section 30 carries a locking tab 80 that is manually slideable between an up-release position (illustrated in broken line in FIG. 8) and a down-latch position. The lower end of tab 80 passes through a slot 82 in the upper wall of slide channel member 46. When tail section 30 is in its second, most extended position, a slot 84 in the upper wall of beam 42, through which tab 80 may pass, registers with slot 82. Pushing tab 80 down through the registered slots 82 and 84 locks tail section 30 in its second extended position.

While a particular embodiment of the present invention has been illustrated and described, changes and modifications will occur to those skilled in the art. It is intended in the appended claims to cover all such variations, changes and modifications as fall within the true spirit and scope of the present invention.

What is claimed as new and desired to be secured by Letters Patent is:

1. A toy vehicle including:
a front to back dimension;
a body having a forward end and a rearward end;
an extendable section carried adjacent one end of the body for extension from a first position adjacent the one end toward a second position to increase the front to back dimension of the vehicle;
the section having a proximal portion engaging the body and a distal portion spaced from the proximal portion and the one end of the body; and
means for extending the section away from the body upon the toy vehicle encountering a change in the angle of a playing surface upon which the toy vehicle moves.

2. The toy vehicle of claim 1 including means biasing the section to the first position.

3. The toy vehicle of claim 1 including:
a pivoting part carried by the vehicle; and
means for pivoting the part from a first condition to a second condition in response to extension of the section.

4. The toy vehicle of claim 1 including means locking the section in one of the positions.

5. A toy vehicle including:
a front to back dimension;
a body having a forward end and a rearward end;
an extendable section carried adjacent one end of the body for extension from a first position adjacent the one end toward a second position to increase the front to back dimension of the vehicle;
the section having a proximal portion engaging the body and a distal portion spaced from the proximal portion and the one end of the body; and
means for extending the section away from the body upon the exertion of a force upon the distal portion of the section in a direction generally transverse to a playing surface upon which the toy vehicle moves.

6. A toy vehicle including:
a front to back dimension;
a body having a forward end and a rearward end;

an extendable section carried adjacent one end of the body for extension from a first position adjacent the one end toward a second position to increase the front to back dimension of the vehicle;

the section having a proximal portion engaging the body and a distal portion spaced from the proximal portion and the one end of the body;

means for extending the section away from the body upon occurrence of a predetermined condition; and a motor cooperating with the means to drive the section away upon the occurrence of the predetermined condition.

7. The toy vehicle of claim 6 including means biasing the extended section to return to the first position.

8. The toy vehicle of claim 6 in which the predetermined condition is the toy vehicle encountering a change in the angle of a playing surface.

9. The toy vehicle of claim 6 in which the predetermined condition is the exertion of a force upon the distal portion of the section in a direction generally transverse to a playing surface.

10. The toy vehicle of claim 6 in which the means includes a rack formed as part of the section and a gear driven by the motor engaging the rack.

11. The toy vehicle of claim 10 in which the rack is spaced from the gear out of engagement with the gear when the section is in the first position and the rack is biased down into engagement with the gear upon occurrence of the predetermined condition.

12. The toy vehicle of claim 11 including:

means biasing the section to the first position; and means driven by the motor to cam the rack up out of engagement with the gear upon the completion of a predetermined cycle.

* * * * *